US005916010A

United States Patent [19]

Varian et al.

[11] Patent Number: 5,916,010

[45] Date of Patent: Jun. 29, 1999

[54] CMP PAD MAINTENANCE APPARATUS AND METHOD

[75] Inventors: Kathryn H. Varian; James T. Varian, both of Hopewell Junction, N.Y.

[73] Assignee: International Business Machines Corporation, Armonk, N.Y.

[21] Appl. No.: 08/960,952

[22] Filed: Oct. 30, 1997

[51] Int. Cl.[6] ..... B24B 1/00

[52] U.S. Cl. ..... 451/38; 451/56; 451/72; 451/287; 451/443; 451/456

[58] Field of Search ..... 451/38, 56, 72, 451/67, 287, 290, 443, 456

[56] References Cited

U.S. PATENT DOCUMENTS

| | | | |
|---|---|---|---|
| 5,125,190 | 6/1992 | Buser et al. | 451/456 |
| 5,154,021 | 10/1992 | Bombardier et al. . | |
| 5,245,796 | 9/1993 | Miller et al. . | |
| 5,384,986 | 1/1995 | Hirose et al. . | |
| 5,522,965 | 6/1996 | Chisholm et al. . | |
| 5,531,861 | 7/1996 | Yu et al. . | |
| 5,578,529 | 11/1996 | Mullins . | |
| 5,603,775 | 2/1997 | Sjöberg . | |
| 5,645,682 | 7/1997 | Skrovan | 451/56 |
| 5,683,289 | 11/1997 | Hempel, Jr. | 451/56 |
| 5,775,983 | 7/1998 | Shendon et al | 451/287 |
| 5,779,522 | 7/1998 | Walker et al. | 451/56 |
| 5,785,585 | 7/1998 | Manfredi et al. | 451/56 |

*Primary Examiner*—Timothy V. Eley
*Assistant Examiner*—Daniel G. Shanley
*Attorney, Agent, or Firm*—DeLio & Peterson LLC; Peter W. Peterson

[57] ABSTRACT

In a chemical-mechanical-polishing (CMP) process, semiconductor substrates are rotated against a polishing pad covered by a layer of polishing slurry. A polishing pad maintenance apparatus is developed to reduce glazing effects, enhance the pad's operating life, achieve uniform planarity through a constant polishing rate, and minimize scratches or other defects from the polished surface, during a chemical-mechanical polishing process. This invention combines both the removal of particles and debris while effectively conditioning the pad surface. The polishing pad maintenance apparatus performs three main functions: loosening particles and debris; conditioning the polishing pad; and, removing the remaining particles and debris that result from the slurry and conditioning processes. The three functions are performed in sequence by a forced fluid spray, an abrasive mechanical agitator, and a vacuum. A conditioning housing assembly supports the three components that perform the maintenance functions: a) a forced fluid spray assembly; b) a mechanically abrasive plate; and, c) a vacuum attachment assembly.

24 Claims, 4 Drawing Sheets

CM P PAD MAINTENANCE APPARATUS AND METHOD

BACKGROUND OF THE INVENTION

1. Field of the Invention

This invention relates in general to an apparatus used in the fabrication of a semiconductor device, and more particularly to an apparatus to aid in the maintenance of the chemical-mechanical-polishing (CMP) process for planarizing a material layer in a semiconductor device.

2. Description of Related Art

It is essential in the fabrication of semiconductor wafers to make the surfaces of the wafers flat for photolithography. Thus, during this fabrication process, it is necessary to polish the wafer to selectively remove excess material from its surface. In a chemical-mechanical-polishing (CMP) process, semiconductor substrates are rotated against a polishing pad covered by a layer of polishing slurry. CMP is used for planarizing bare silicon wafers, interlevel dielectrics, and other materials.

CMP involves both chemical and mechanical abrasion. Chemical abrasion is accomplished through a slurry to chemically weaken the surface of the wafer. Mechanical abrasion is accomplished using a polishing pad against which a wafer surface is pressed.

The slurry chemically degrades the wafer surface to make the surface more easily removed by the mechanical abrasion. One example of a slurry usable for polishing deposited layers on semiconductor wafers is a colloidal suspension of silica particles in an approximately 10.5 pH solution of water and KOH.

The material of the polishing pad is chosen for its ability to act as a carrier of the slurry and to wipe away the grit and debris resulting from the polishing action.

Chemical compounds within the wafer slurry undergo a chemical reaction with material of the insulating layer to enhance the rate of removal. However, debris on the surface of the polishing pad can be formed by the accumulation of chemical reaction products and abrasives in the slurry, which may reduce the polishing rate because the mass transfer rate of the polishing slurry is reduced. This effect is called "glazing". Thus, after continued use, the polishing surface of the pad will deteriorate and need replacement.

Limited prior art techniques have introduced a number of methods to reduce the glazing effects. In one method, ultrasonic energy was introduced in the polishing slurry to overcome the instability caused by glazing of the polishing pad. In another, a brush was used on a polishing cloth to remove debris.

In U.S. Pat. No. 5,522,965, issued to Chisholm, et al., on Jun. 4, 1996, entitled, "COMPACT SYSTEM AND METHOD FOR CHEMICAL-MECHANICAL POLISHING UTILIZING ENERGY COUPLED TO THE POLISHING PAD/WATER INTERFACE", the approach to conditioning consists of a transducer emitting ultrasonic energy during the polishing process. However, unlike the present invention, there is no cleaning step, abrasive conditioning, or vacuuming of the pad surface.

Similarly, in U.S. Pat. No. 5,384,986, issued to Hirose, et al., on Jan. 31, 1995, entitled, "POLISHING APPARATUS", polishing of the silicon wafer is detailed, but not pad maintenance. In Hirose, et al., an abrasive cloth is used for polishing, not a conventional polyurethane pad. A rotatable brush oscillating between inner radial and outer radial positions on the abrasive cloth (in lieu of a pad) is used to remove debris and reduce glazing. Although a cleaning solution is sprayed over this cloth material, no abrasive conditioning of the cloth is described.

Spray bars have also been developed to clean the polishing pad. In U.S. Pat. No. 5,578,529, issued to Mullins, on Nov. 26, 1996, entitled, "METHOD FOR USING RINSE SPRAY BAR IN CHEMICAL MECHANICAL POLISHING", a rinse bar was added to CMP equipment to provide uniform wetting and rinsing of the polishing pad. Similarly, in U.S. Pat. No. 5,154,021, issued to Bombardier, et al., on Oct. 13, 1992, entitled, "PNEUMATIC PAD CONDITIONER", an air jet assembly supported over a polishing pad provided for raising flattened fibers on the pad pressed down by the polishing of semiconductor wafers, and for blowing spent polishing materials and by-products off the pad. However, these patents do not cover any abrasive conditioning or vacuuming of the pad surface.

The prior art has limitations in the implementation of the CMP process. Polishing actions must be carried out in such a way that scratches or other defects do not appear on the polished wafer surface. Additionally, in order to achieve uniform planarity a constant polishing rate must be maintained when using a pad that requires conditioning. Pad conditioning would be desirable to reduce glazing effects, otherwise the pad's polishing rate and operating life are appreciably degraded.

Consequently, it has been found that active pad maintenance is critical to reducing the disadvantages associated with the CMP process.

Bearing in mind the problems and deficiencies of the prior art, it is therefore an object of the present invention to provide an apparatus for maintaining a polishing pad used in a chemical/mechanical polishing (CMP) process.

It is another object of the present invention to provide a pad maintenance method to efficiently condition the pad and clear debris.

It is another object of the present invention to provide for the removal of particles and debris on the polishing pad surface while effectively conditioning the pad surface during a CMP process.

It is another object of the present invention to minimize the scratching of product wafers during the CMP process.

It is another object of the present invention to maintain a constant polishing rate when using a pad that requires conditioning.

It is yet another object of the present invention to extend the polishing pad's life through the minimization of accumulated debris on the pad's surface.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, an apparatus for maintaining a polishing pad, used in a chemical-mechanical polishing process and having particles to be removed from a surface of the pad, comprising: a means for contacting the pad surface with an abrasive; a means for loosening particles from the pad surface; and, a means for removing the particles from the pad surface.

A further aspect of the present invention relates to an apparatus for maintaining a polishing pad, used in a chemical-mechanical polishing process and having particles to be removed from a surface of the pad, comprising: a base having a rotatable workpiece holder for securing a pad having particles on a surface of the pad; a mechanically abrasive agitator, secured to the base, adapted to contact the pad surface; a spray nozzle, secured to the base, adapted to loosen particles from the pad surface; and, a particle remover adapted to removing the particles loosened by the agitator and nozzle from the pad surface. Preferably, the polishing pad motion is relative to the mechanically abrasive agitator.

Yet another aspect of the present invention relates to an apparatus for maintaining a polishing pad used in a chemical-mechanical polishing process comprising: a conditioning head assembly for housing individually or in any combination thereof, a mechanically abrasive agitator, a spray nozzle, and a particle remover; a conditioner plate for providing the mechanical agitation to the polishing pad; a fluid spray assembly for loosening the particles and debris from the pad surface; and, a vacuum attachment assembly for removing the remaining loose particles from the polishing pad. The conditioning housing assembly has attachments to support the conditioner plate, the fluid spray assembly, and the vacuum attachment assembly. The conditioning housing assembly is secured to a support arm attached to the chemical-mechanical polishing tool or other stationary device. One method of attachment is by bolting the conditioning housing assembly to the support arm.

The fluid spray assembly comprises an outlet or an array of nozzles adapted to direct the fluid away from the conditioner toward the edge of the pad to remove particles from the path of the conditioner. The vacuum attachment assembly is adapted to secure conditioning housing assembly such that, when a vacuum is applied, the vacuum removes the particles from the pad surface.

In yet a further aspect of the present invention relates to a conditioner plate having a radial orientation with respect to the rotatable workpiece holder. The conditioner plate is adapted to extend about the center of the pad to the edge of the pad. Preferably, the conditioner plate comprises a diamond finish abrasive surface to form abrasions on the pad surface.

Another aspect of the present invention relates to the conditioning housing assembly with an attachment mechanism to secure the conditioning housing assembly to a support arm attached to the chemical-mechanical polishing tool or other stationary structure. The conditioning plate within the conditioning housing assembly is attached to a conditioning plate arm which can be electronically or manually controlled to provide pressure between the conditioning plate surface and the pad surface.

Another aspect of the present invention relates to a method for maintaining a polishing pad, used in a chemical-mechanical polishing process comprising the steps of: providing a pad with particles to be removed from a surface of the pad; contacting the pad surface with an abrasive; loosening particles and debris from the pad surface; and, removing the slurry, particles, and debris from the pad surface by a vacuum. The method of contacting the pad surface with an abrasive comprises applying mechanical agitation to condition the pad surface. In contacting the pad surface with an abrasive to condition the pad surface, the mechanical agitation is applied along a radial orientation with respect to the pad.

Another aspect of the present invention relates to a method for simultaneous removal of particles and debris during the application of mechanical agitation to the pad surface. Preferably, the loosening of the particles and debris from the pad surface is performed by applying a stream of forced fluid before the pad is conditioned. The preferred application is to direct the fluid spray towards the edge of the pad to remove particles and debris away from the substrate and the device performing the mechanical agitation. In applying the mechanical agitation, a relative motion between the polishing pad and the mechanically abrasive agitator is provided. Preferably, this relative motion is rotational with respect to the contacting surfaces.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
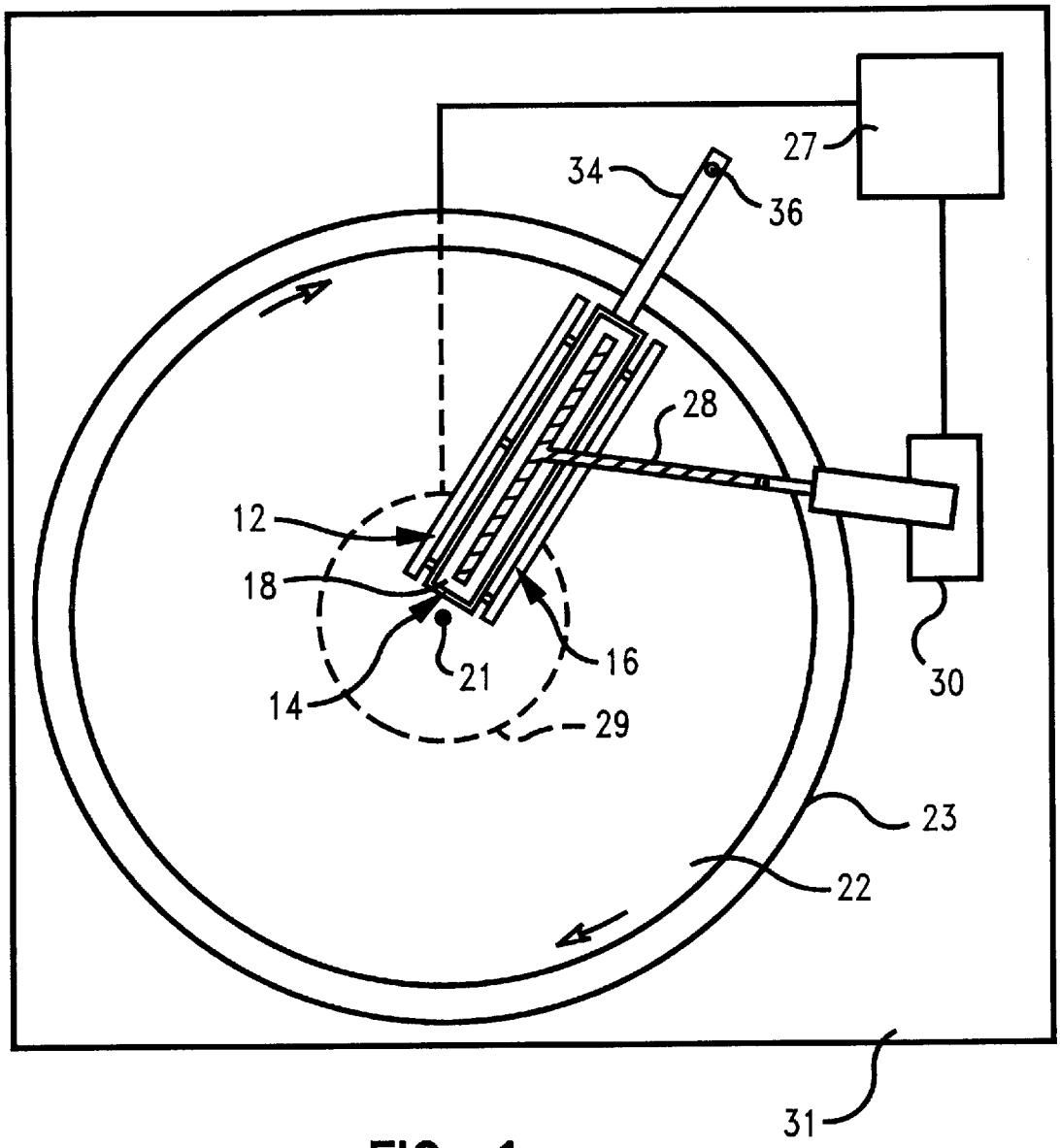
FIG. 1 is a top plan view (partially in schematic) of a preferred CMP pad maintenance apparatus in accordance with the present invention, including a forced fluid spray, a conditioning head, and a vacuum attachment assembly.

In describing the preferred embodiment of the present invention, reference will be made herein to FIGS. 1–4 of the drawings in which like numerals refer to like features of the invention. Features of the invention are not necessarily shown to scale in the drawings.

The present invention addresses the problems associated with the prior art of: a) scratching of product wafers during the CMP process; b) maintaining a constant polishing rate when using a pad that requires conditioning; c) reducing the degrading effects of glazing; and, d) extending the polishing pad's useful life.

This is accomplished in the present invention by conditioning the pad and removing particles generated during both the polishing and conditioning processes.

A preferred CMP pad maintenance apparatus is shown in FIG. 1. This apparatus performs three main functions: loosening particles and debris; conditioning the polishing pad; and, removing the remaining particles and debris that result from the slurry and conditioning processes. The three functions are performed in sequence by a forced fluid spray, an abrasive mechanical agitator (conditioner), and a vacuum, respectively. Although the order of these process steps achieves a degree of efficiency, other process sequences may be implemented.

FIG. 1 depicts a preferred pad maintenance apparatus. A conditioning housing assembly 14 houses the components that perform the pad maintenance functions: a forced fluid spray, an abrasive mechanical conditioner, and a vacuum. Conditioning assembly 14 is radially disposed over circular polishing pad 22 and supported by support arm 34, which may be attached to the chemical mechanical polishing tool by bolts 36, and by conditioning plate arm 28 secured to stand 30 adjacent the pad on CMP apparatus base 31. A motor 29 within base 31 rotates circular workpiece turntable 23 on which pad 22 is secured. A microprocessor based controller 27 is linked to the motor and conditioning assembly to control the operation thereof.

The conditioning housing assembly supports elongated conditioning plate 18 which extends from center 21 to the edge of pad 22 and performs mechanical abrasions on the polishing pad 22 when it is pressed against the pad while the pad is rotating relative thereto. As long as the pad surface is moving relative to the conditioning plate while they are in contact, mechanical abrasions will occur.

The vacuum head 16 is housed in the conditioning housing assembly and likewise extends from the pad center 21 to the pad edge. Unique to this invention, the vacuum head is attached to a source of vacuum (not shown) and removes the remaining particles and debris loosened by the slurry, fluid spray, and mechanical agitator.

Current pad conditioning methods are designed to only condition the pad surface, not to remove the particles or debris generated during processing.

Figure 2:
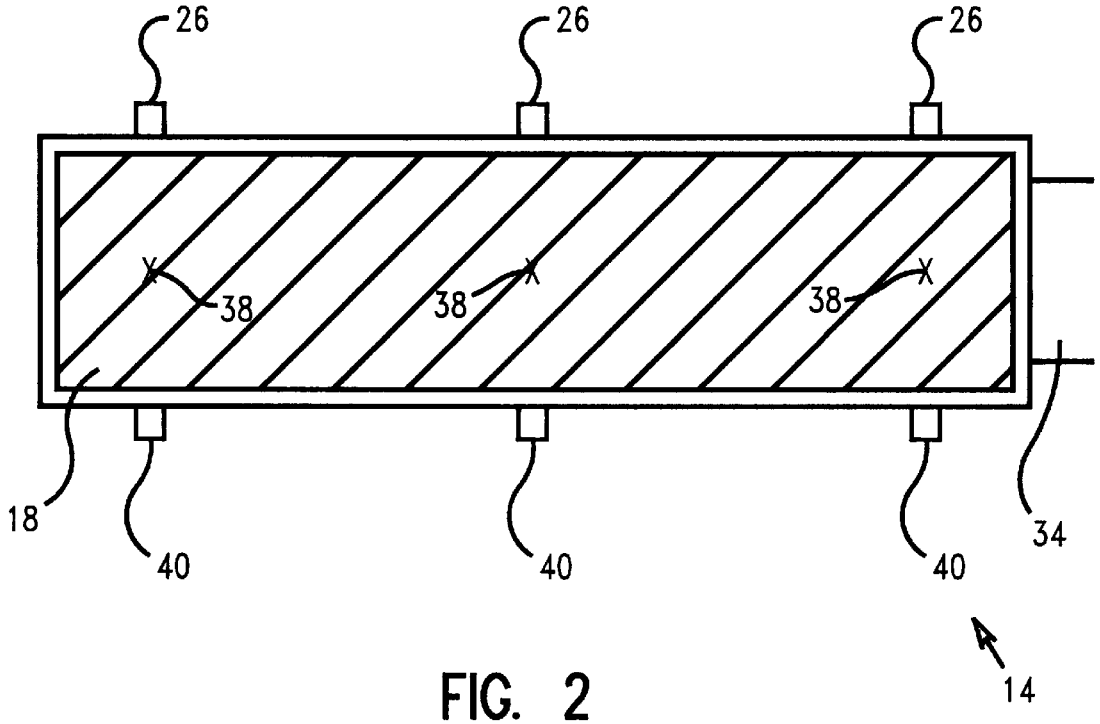
FIG. 2 is a top plan view of the conditioning head assembly utilized in the apparatus of FIG. 1.

FIG. 2 shows the conditioning housing assembly 14 depicted in FIG. 1. The conditioning housing assembly houses conditioner plate 18, as well as provides support for the adjacently mounted forced fluid spray assembly 12 through multiple connections 26, and vacuum head 16 through multiple connections 40.

The conditioning housing assembly may be secured to the stationary CMP tool via a support arm 34, or to a stationary support structure away from the CMP tool. The conditioning plate 18 is mounted within the framework of the assembly and is attached at multiple attachment points 38. The conditioning plate provides the mechanical abrasive when pressed against the polishing pad surface. The current invention utilizes a plate with a diamond finished abrasive, however, other abrasives may also be used to achieve the same purpose.

Conditioning plate arm 28 delivers sufficient force to press the abrasive material of the conditioner plate against the pad surface. Arm 28 is programmable, controlled by the CMP tool's controller 27, and can be set to either raise or lower the conditioning plate. Conditioning takes place when the plate is lowered to contact the polishing pad. When conditioning is no longer required, the arm can raise the plate off the pad surface. In this way, conditioning can be performed between polishing intervals and also during polishing.

Figure 3:
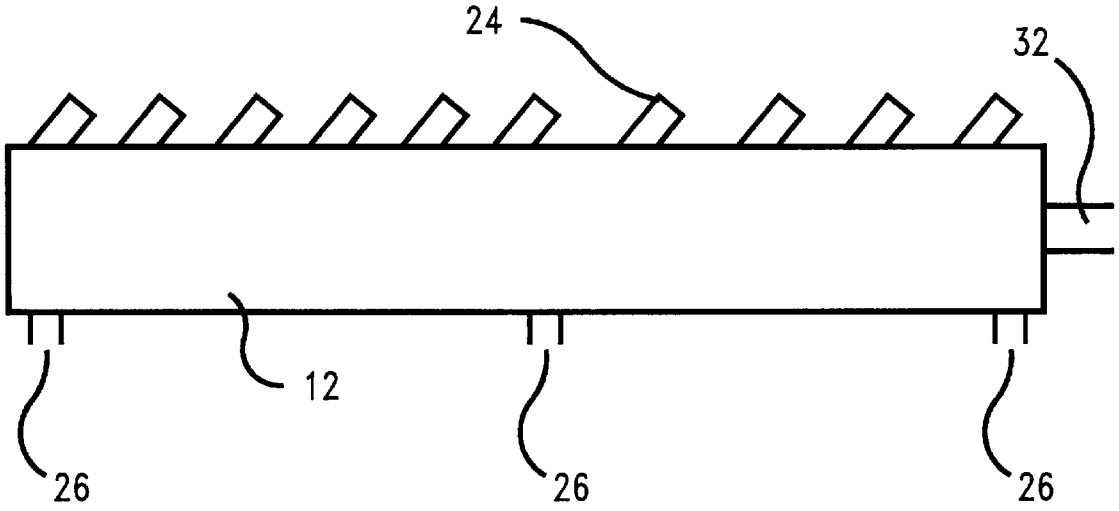
FIG. 3 is a top plan view of the forced fluid spray assembly with associated nozzle outlets utilized in the apparatus of FIG. 1.

FIG. 3 depicts the forced fluid spray assembly 12 which is radially oriented over pad 22 (not shown). The purpose of the forced fluid spray is to clear the pad of all loose particles and debris before the pad is conditioned. In this way the particles are not embedded into the pad by the conditioning plate. The forced fluid spray is typically a water spray but may be other appropriate aqueous fluid washes.

The forced fluid spray also extends the pad life by minimizing the glazing or accumulation of debris on the pad's surface. If not removed, this glazing build-up can deteriorate the pad's performance in terms of polish rate and uniformity. An array of nozzles 24 extending along spray assembly 12 are angled such that the fluid sprays away from the conditioning plate and towards the outer edge of the pad, thus, removing the particles from the conditioner's path. An attachment 32 to a fluid source (not shown) is located at least one end of the assembly. Multiple attachments 26 for connection to the conditioning housing assembly are shown on the surface of the assembly facing the pad. Although three securing attachments points are depicted, any number of attachments can be used to effectively perform this function.

While conditioning, the forced fluid spray removes particles from the polishing pad thus minimizing the incidence of scratching.

Another feature of this invention is the ability to have a conditioning pad that spans the full radial length of the polishing pad. This enables the pad to be conditioned throughout the full path that the wafer travels during polishing. Thus, the entire pad surface may be uniformly conditioned during the polishing cycle.

Figure 4:
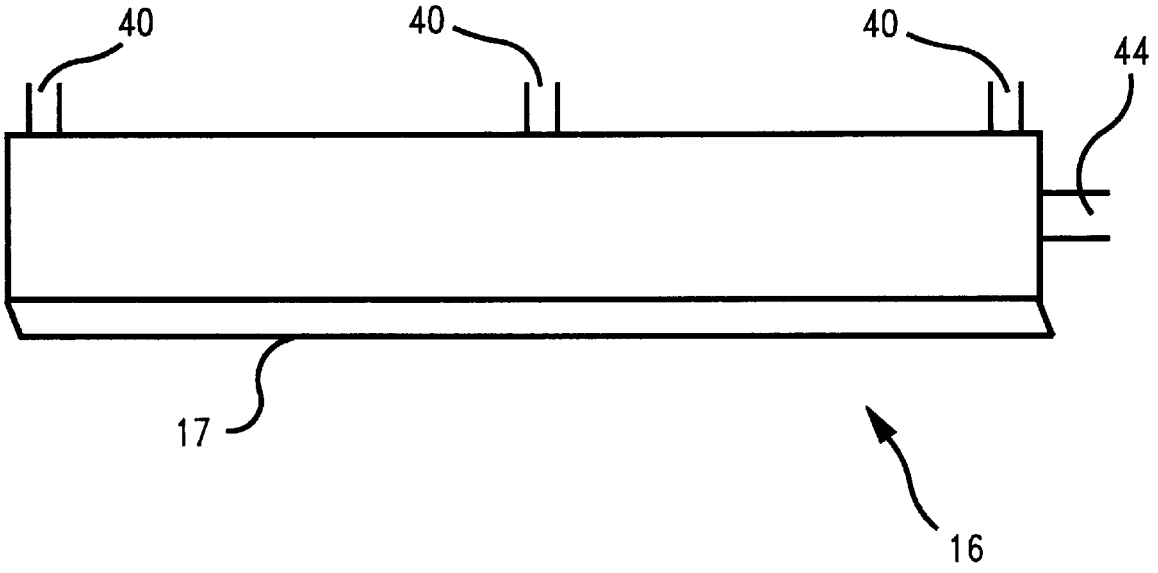
FIG. 4 is a side elevation view of the vacuum attachment assembly utilized in the apparatus of FIG. 1.

FIG. 4 depicts the vacuum head 16. The purpose of the vacuum is to remove any loose particles missed by the forced fluid spray or created by the conditioner. The vacuum attachment structure has an opening 17 on the side facing the pad and is attached to the conditioning housing assembly at multiple attachment points 40 so as to be positioned just above the polishing pad surface. The vacuum attachment 44 structure provides for an attachment to a vacuum source (not shown) which can establish a minimum vacuum of 20 to 30 inches of mercury. The vacuum is applied after the forced fluid spray and conditioning processes.

The operation of the CMP apparatus and method for maintaining a polishing pad surface begins soon after a semiconductor substrate has been pressed against a rotating polishing pad that is covered by a layer of polishing slurry. The semiconductor substrate alters the polishing pad surface, pressing and flattening the fibers, thus degrading the effectiveness of the polishing process. A conditioning housing assembly houses the forced fluid spray assembly, the conditioning plate, and the vacuum attachment assembly of this apparatus. The conditioning housing assembly is supported by either the stationary chemical-mechanical polishing tool or any other stationary support structure away from the CMP tool. Although the conditioning plate arm that raises and lowers the conditioning plate is programmable, this feature is not essential to the current invention. The forced fluid spray assembly is activated to move particles towards the edge of the polishing pad away from the substrate. A pad conditioning plate is pressed against the polishing pad. The conditioning plate comprises a diamond finished abrasive, although other abrasives may be substituted. The forced fluid spray and pad conditioning may be operated simultaneously or sequentially. After the abrasive has conditioned the pad, a vacuum is applied to remove all remaining particles from the polishing and pad conditioning process. This complete operation may be performed either during the polishing process or when the substrate is not pressed against the polishing pad.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for maintaining a polishing pad having an edge, used in a chemical-mechanical polishing process for polishing a substrate comprising the steps of:

a) providing a pad with particles to be removed from a surface of said pad;

b) contacting said pad surface with an abrasive;

c) applying a chemical slurry to loosen particles from said pad surface; and d) removing said slurry and said particles from said pad surface by vacuum along a radial orientation with respect to said pad.

2. The method of claim 1 wherein said step of contacting said pad surface with an abrasive comprises applying mechanical agitation to condition said pad surface.

3. The method of claim 2 wherein said step of applying mechanical agitation to condition said pad surface further comprises providing a relative motion between said polishing pad and said mechanically abrasive agitator.

4. The method of claim 3 wherein said step of providing a relative motion between said polishing pad and said mechanically abrasive agitator further comprises a rotational motion.

5. The method of claim 1 wherein said step of contacting said pad surface with an abrasive to condition said pad surface comprises applying said mechanical agitation along a radial orientation with respect to said pad.

6. The method of claim 1 wherein said steps (b) and (c) are performed simultaneously.

7. The method of claim 1 wherein said step (c) of loosening particles from said pad surface comprises applying a stream of forced fluid.

8. The method of claim 7 wherein said step of applying a stream of forced fluid comprises clearing said pad of loose particles before said pad is conditioned.

9. The method of claim 7 wherein said step of applying a stream of forced fluid comprises directing said fluid spray towards the edge of said pad to remove particles away from the substrate and the abrasive performing mechanical agitation.

10. An apparatus for maintaining a polishing pad having an edge, comprising:

a base having a rotatable workpiece holder for securing a pad having particles on a surface of said pad;

a mechanically abrasive agitator secured to said base adapted to contact said pad surface;

a spray nozzle secured to said base adapted to loosen particles from said pad surface;

a particle remover adapted to removing said particles loosened by said agitator and nozzle from said pad surface;

a conditioning assembly for housing said mechanically abrasive agitator, said spray nozzle, and said particle remover;

a conditioner plate for providing said mechanical agitation to said polishing pad;

a fluid spray assembly for loosening said particles and debris from said pad surface; and a vacuum attachment assembly for removing remaining said loose particles from said polishing pad.

11. The apparatus of claim 10 wherein said conditioning housing assembly further comprises attachments to support said conditioner plate, said fluid spray assembly, and said vacuum attachment assembly.

12. The apparatus of claim 10 wherein said conditioning housing assembly further comprises an attachment to secure said conditioning housing assembly to a support arm attached to said apparatus or to a stand adjacent said pad.

13. The apparatus of claim 12 wherein said attachment comprises a bolt attachment to said support arm.

14. The apparatus of claim 10 wherein said fluid spray assembly comprises an outlet adapted to direct said fluid away from said conditioner toward the edge of said pad to remove particles away from said conditioner.

15. The apparatus of claim 10 wherein said fluid spray assembly comprises an array of nozzles adapted to direct said fluid away from said conditioner toward the edge of said pad to remove particles away from said conditioner.

16. The apparatus of claim 10 wherein said vacuum attachment assembly comprises attachments adapted to secure said vacuum attachment assembly to said conditioning housing assembly such that when applied, said vacuum removes said particles from said pad surface.

17. The apparatus of claim 10 wherein said conditioner plate has a radial orientation with respect to said rotatable workpiece holder.

18. The apparatus of claim 17 wherein said conditioner plate is adapted to extend about the center of said pad to the edge of said pad.

19. The apparatus of claim 17 wherein said conditioner plate includes a diamond finish abrasive surface adapted to form abrasions on said polishing pad surface.

20. The apparatus of claim 10 further comprising an attachment mechanism to secure said conditioning housing assembly to a support arm attached to said apparatus or to a stand adjacent said pad.

21. The apparatus of claim 10 wherein said conditioning housing assembly with a conditioning plate is supported by a conditioning plate arm such that said arm is electronically or manually controlled to provide pressure between said conditioning plate and said pad.

22. An apparatus for maintaining a polishing pad having an edge, used in a chemical-mechanical polishing process and having particles to be removed from a surface of said pad, comprising:

a base having a rotatable workpiece holder for securing a pad having particles on a surface of said pad;

a mechanically abrasive agitator secured to said base adapted to contact said pad surface;

a spray nozzle secured to said base adapted to loosen particles from said pad surface;

a particle remover adapted to removing said particles loosened by said agitator and nozzle from said pad surface; and a conditioning assembly for housing in any combination, said mechanically abrasive agitator, said spray nozzle, and said particle remover.

23. The apparatus of claim 22 wherein said polishing pad moves relative to said mechanically abrasive agitator.

24. An apparatus for maintaining a polishing pad, used in a chemical-mechanical polishing process and having particles to be removed from a surface of said pad, comprising:

a means for contacting said pad surface with an abrasive;

a means for loosening particles from said pad surface;

a means for removing said particles from said pad surface; and a housing for said contacting means, said loosening means, and said removing means.

* * * * *